US008192607B2

(12) United States Patent
Königshofen et al.

(10) Patent No.: US 8,192,607 B2
(45) Date of Patent: Jun. 5, 2012

(54) ELECTROLYTE AND PROCESS FOR DEPOSITING A MATT METAL LAYER

(75) Inventors: Andreas Königshofen, Leverkusen (DE); Danica Elbick, Solingen (DE); Christoph Werner, Düsseldorf (DE); Wolfgang Clauberg, Neuss (DE); Peter Pies, Köln (DE); Andreas Möbius, Kaarst (DE)

(73) Assignee: Enthone Inc., West Haven, CT (US)

( * ) Notice: Subject to any disclaimer, the term of this patent is extended or adjusted under 35 U.S.C. 154(b) by 0 days.

(21) Appl. No.: 12/168,680

(22) Filed: Jul. 7, 2008

(65) Prior Publication Data

US 2008/0302668 A1 Dec. 11, 2008

Related U.S. Application Data

(63) Continuation-in-part of application No. PCT/EP2006/000076, filed on Jan. 6, 2006.

(51) Int. Cl.
*C23C 18/36* (2006.01)
*C25D 3/56* (2006.01)
*C25D 3/12* (2006.01)

(52) U.S. Cl. ..... 205/259; 205/246; 205/255; 205/271; 106/1.27

(58) Field of Classification Search ..... 205/238, 205/239, 240, 241, 242, 243, 244, 245, 246, 205/247, 250, 251, 252, 253, 255, 257, 259, 205/262, 263, 264, 265, 266, 267, 269, 270, 205/271, 272, 283, 290, 291, 296, 299, 300, 205/302, 305, 311, 315; 106/1.27
See application file for complete search history.

(56) References Cited

U.S. PATENT DOCUMENTS

| | | | | |
|---|---|---|---|---|
| 3,787,294 | A * | 1/1974 | Kurosaki et al. | 205/109 |
| 3,839,165 | A * | 10/1974 | Strauss et al. | 205/276 |
| 4,381,228 | A * | 4/1983 | Teichmann et al. | 205/241 |
| 4,444,630 | A * | 4/1984 | Steinecker | 205/313 |
| 5,194,125 | A * | 3/1993 | Cachet et al. | 205/609 |
| 5,401,590 | A * | 3/1995 | Chalilpoyil et al. | 429/59 |
| 5,897,763 | A * | 4/1999 | Elligsen et al. | 205/271 |
| 6,498,207 | B1 * | 12/2002 | Hoshikawa et al. | 524/378 |
| 7,074,315 | B2 | 7/2006 | Desmaison et al. | |
| 7,361,262 | B2 | 4/2008 | Dahms et al. | |
| 7,695,605 | B2 | 4/2010 | Whitlaw et al. | |
| 2005/0072683 | A1 * | 4/2005 | Nakada et al. | 205/296 |

FOREIGN PATENT DOCUMENTS

| | | | |
|---|---|---|---|
| CN | 1563505 A | | 1/2005 |
| DE | 3909811 | | 9/1990 |
| EP | 1308541 | | 5/2003 |
| FR | 2190940 | * | 1/1974 |
| FR | 2190940 | | 2/1974 |
| JP | 2001089897 | | 4/2001 |
| JP | 2001125413 | | 5/2001 |
| JP | 2001226798 | | 8/2001 |
| JP | 2001226798 A | * | 8/2001 |
| JP | 2002317298 | | 10/2002 |

OTHER PUBLICATIONS

Bhalla et al., "Friction and Wear Characteristics of Electrodeposited Copper Composites", Plating and Surface Finishing, Nov. 1995, vol. 82, No. 11, pp. 58-61.*
Bapu et al., "Electrodeposition of Nickel-Polytetrafluoroethylene (PTFE) Polymer Composites", Plating and Surface Finishing (Apr. 1995), vol. 82, No. 4, pp. 86-88.*
Lion Corporation Chemical Division, "3 Cationic Surfactants", c. no month, 1996-2002, pp. 1-4.*
Masurf FS-Fluorosurfactants, no date, pp. 1-3.*
Lion Corporation Chemicals Division, "3 Cationic Surfactants", c. no month, 1996-2002, pp. 1-4.*
Zhu et al., "Study on Co-Electrodeposition of Metal Nickel and Polytetrafluoroethylene (II): Selection of Surfactants," Shenyang Huagong Xueyuan Xuebao (no month, 1998), vol. 12, No. 3, pp. 155-161.*
Abstract of JP2002317298; Oct. 31, 2002.
International Search Report, PCT/EP2006/000076, dated Sep. 29, 2006, 6 pages.
Written Opinion, PCT/EP2006/000076, dated Sep. 29, 2006, 4 pages.
International Preliminary Report on Patentability; PCT/EP2006/000076, dated Sep. 12, 2008, 2 pages.
Abstract of CN1563505; Jan. 12, 2005.

* cited by examiner

*Primary Examiner* — Edna Wong
(74) *Attorney, Agent, or Firm* — Senniger Powers LLP

(57) ABSTRACT

An electrolytic composition for the deposition of a matt metal layer onto a substrate and deposition process where the composition comprises a source of metal from the group consisting of Cr, Mn, Fe, Co, Ni, Cu, Zn, Ru, Rh, Pd, Ag, In, Sn, Sb, Re, Pt, Au, Bi, and combinations thereof;

a substituted or unsubstituted polyalkylene oxide or its derivative as an emulsion and/or dispersion former; and a compound comprising fluorated or perfluorated hydrophobic chains or which is a polyalkylene oxide substituted quaternary ammonium compound as wetting agent; wherein the electrolytic composition forms a microemulsion and/or dispersion.

9 Claims, No Drawings

ELECTROLYTE AND PROCESS FOR DEPOSITING A MATT METAL LAYER

REFERENCE TO RELATED CASE

This application is a continuation-in-part of international application PCT/EP2006/000076, filed 6 Jan. 2006, the entire disclosure of which is hereby incorporated by reference.

FIELD OF THE INVENTION

The present invention relates to an electrolyte and to a process for depositing a matt metal layer on a substrate from an electrolyte comprising an emulsion and/or dispersion former or a wetting agent.

BACKGROUND OF THE INVENTION

In the production of metallic layers on substrates the aim generally is to obtain preferably smooth and high gloss coats. But depending on the specific application, it is frequently desired to obtain a metal coat which is not glossy but matt. The reason for that may be the optical appearance of this coat, and also the technical properties, i.e. the nonglaring of such coats. Fields of application for matt deposited metal layers on substrates are for instance the jewelry industry, fittings industry, automobile industry, but also the optical and precision industry, where especially the nonglaring of these coats is important. From prior art matt deposited nickel or nickel alloy layers as well as cobalt layers are known. While the deposition of such potentially allergy-causing metals is noncritical in many fields, it is desirable to avoid these metals in the field of the jewelry industry or also in the field of kitchenware and kitchen utensils. Within the field of the optical or precision industries the deposition of matt metal layers of the most different metals is desirable because of the different properties of the respective metals. In addition, it is desirable to be able to adjust the degree of mattness of the deposited metal layer over a vast range. It is an object of the present invention to provide an electrolyte as well as a process for depositing matt metal layers on substrates, by which method a variety of metals can be deposited with different degrees of mattness on the most different substrates.

Briefly, therefore, the invention is directed to an electrolytic composition for the deposition of a matt metal layer onto a substrate and deposition process where the composition comprises a source of metal from the group consisting of Cr, Mn, Fe, Co, Ni, Cu, Zn, Ru, Rh, Pd, Ag, In, Sn, Sb, Re, Pt, Au, Bi, and combinations thereof; a substituted or unsubstituted polyalkylene oxide or its derivative as an emulsion and/or dispersion former; and a compound comprising fluorated or perfluorated hydrophobic chains or which is a polyalkylene oxide substituted quaternary ammonium compound as wetting agent; wherein the electrolytic composition forms a microemulsion and/or dispersion.

Other objects and features of the invention will be in part apparent and in part pointed out hereinafter.

DETAILED DESCRIPTION OF PREFERRED EMBODIMENTS

The objects of the invention are achieved by an electrolyte for depositing a matt metal layer on a substrate from an electrolyte comprising an emulsion and/or dispersion former or a wetting agent, characterized in that the electrolyte includes for a metal to be deposited a metal from the group consisting of Al, Ti, V, Cr, Mn, Fe, Co, Ni, Cu, Zn, As, Se, Mo, Ru, Rh, Pd, Ag, Cd, In, Sn, Sb, Te, W, Re, Pt, Au, Ti, Pb, Bi, preferably from the group consisting of Cr, Mn, Fe, Co, Ni, Cu, Zn, Ru, Rh, Pd, Ag, In, Sn, Sb, Re, Pt, Au, Bi, or an alloy of these metals, that the emulsion and/or dispersion former is a substituted or unsubstituted polyalkylene oxide or its derivative, that the wetting agent includes fluorated or perfluorated hydrophobic chains or is a polyalkylene oxide substituted quaternary ammonium compound, and that the electrolyte, emulsion and/or dispersion formers or wetting agents form a microemulsion and/or dispersion.

Concerning the process, the object is solved by a process for electrolytically depositing a matt metal layer on a substrate, wherein the substrate is connected with a voltage source in a galvanizing bath that comprises an electrolyte according to the invention and a counter electrode, and a current which is suitable for depositing a metal layer on the substrate is applied between the substrate and the counter electrode.

It has been discovered that the formation of microemulsions in electrolytes is suitable for the matt deposition of the most different metals from the corresponding electrolytes. Further, it has been discovered that for the formation of these microemulsions in electrolytes of most different metals to be deposited both polyalkyleneglycols or their derivatives, wetting agents with fluorated or perfluorated hydrophobic chains, and quaternary ammonium compounds substituted by polyalkylene oxide chains are suited. These compounds can be used in a vast range for the production of emulsions in electrolytes of the most different metals and they can be used individually.

If polyalkyleneglycols are used for the emulsion and/or dispersion formers, especially polymers with different percentages of hydrophilic and hydrophobic structures, preferably consisting of polyethylene and polypropylene glycols turned out to be suitable in addition to homogeneously structured polymers. In this case it is among others the percentage of hydrophilic and hydrophobic structures which is decisive for the degree of mattness of the deposited metal layer in dependence of the average molecular weight, wherein average molecular weights >200 g/mol, for polymers with a high percentage of hydrophobic structures preferably 200 to 2000 g/mol, and for polymers with a high percentage of hydrophilic structures even more preferably >4000/mol are generally suited.

At the use of fluorated or perfluorated wetting agents, wetting agents of the general formula $$R^fCH_2CH_2O(CH_2CH_2O)_xH \qquad \text{(formula 1)}$$

with $R^f{=}F(CF_2CF_2)_n$, wherein X=6 to 15 and n=2 to 10, are particularly suited. The average molecular weight of the fluorated or perfluorated wetting agents is, according to the invention, between about 550 and about 1000 g/mol, preferably between about 700 and about 1000 g/mol. In this case, too the average molecular weight has an influence on the degree of mattness.

Another type of wetting agent suitable for the deposition of metal layers from electrolytes in accordance with the invention is polyalkylene oxide-substituted quaternary ammonium compounds preferably following the general formula (formula 2)

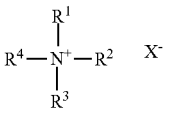

wherein at least one radical $R^1$, $R^2$, $R^3$ or $R^4$ is a polyalkylene oxide substituent and the remaining radicals independently are same or different straight-chained or branched saturated or unsaturated $C_1$ to $C_{18}$ alkyl chains and $X^-$ is a halide, a sulfate anion or anion of a $C_1$ to $C_6$ carboxylic acid. It turned out that especially quaternary ammonium compounds of the general formula 2 are suited, in which $R^1$ and $R^2$ are a $C_8$ to $C_{12}$, preferably a $C_{10}$ alkyl side chain, $R^3$ is a $C_1$ to $C_3$, preferably a $C_1$ alkyl side chain, $R^4$ corresponds to the general formula $[CH_2—CH_2—O]_nH$ with n=1 to 5, and $X^-$ is the anion of a $C_2$ to $C_4$ carboxylic acid.

The average molecular weight of the quaternary ammonium compound which is added to the electrolyte, in accordance with the invention, is between about 200 to about 1000 g/mol, preferably between 400 and about 500 g/mol and even more preferably between about 450 and about 460 g/mol.

Additionally it turned out that the addition of polytetrafluorethylene particles to the electrolyte according to the invention has an influence on the properties of the deposited matt metal layers. Accordingly, in the deposition of matt metal layers from electrolytes according to the invention which additionally contain polytetrafluorethylene particles a surface appears which is considerably softer concerning tactility and which even exhibits a clearly lower susceptibility to finger prints (touch free) compared to matt surfaces which have been deposited from electrolytes according to the invention without the addition of polytetrafluorethylene particles.

It has been discovered that the medium particle diameter of the added polytetrafluorethylene particles should be within a range of about 10 to about 1000 nm, preferably about 100 to about 300 nm.

According to the invention, the polytetrafluorethylene particles can be added at a concentration between about 0.1 and 1000 mg/l, preferably between about 0.5 and 5 mg/l.

The preferred deposition parameters include a working temperature between 50 and 55° C., a current density between about 3 and about 7 A/dm$^2$, and an exposure time of the substrate to the electrolyte of between about 5 and about 20 minutes.

The following examples show embodiments of the electrolyte according to the invention as well as of the process according to the invention, but the invention cannot be limited to these exemplary embodiments.

Example 1

A Cu electrolyte having the following composition:
55 g/l $Cu^{2+}$
66 g/l $H_2SO_4$
100 mg/l $Cl^-$
200 mg/l bis-(3-sulfopropyl)-disulfide, disodium salt
are mixed with 2 g/l polypropyleneglycol having a molar mass of 900 g/mol. Galvanizing takes places on an angular sheet for 10 minutes at 5 A/d m$^2$ and 35° C., with the cathode being moved 2 m/min.

Air movement is not required. Surprisingly, a uniform pearlescent effect is obtained in the high and low current density region. Because of the minimum amount of organic brighteners, there are no adherence problems during a current interruption and thereafter adhering layers can be deposited from an acidic bronze electrolyte or from a trivalent chromium electrolyte. The degree of mattness of the pearlescent effect can be controlled through the concentration of the polymer. By a single filtering over Celite all of the pearlescent brightener is removed.

Example 2

When using the parameters described in example 1, a stable and uniform pearlescent effect is obtained at 26° C. and with the addition of 300 mg/l of a polyalkyleneglycol having the following block polymer structure instead of the polypropyleneglycole described in example 1:

$$HO—(CH_2—CH_2—O)_x—(CH_2—CH(CH_3)—O)_y—(CH_2—CH_2—O)_n—H$$

The average molecular weight amounts to 1700 g/mol, with the polyethylene oxide fraction (x+z) being 20% of the molecular mass.

Example 3

In a bronze electrolyte having the following composition:
12 g/l Cu(II)
2 g/l Sn(II)
100 g/l methanesulfonic acid
2 g/l hydrochinone
there is also obtained a uniform pearlescent effect with 5 mg/l polyalkyleneglycol having the block polymer structure shown in example 2 with a molecular mass of 5000 g/mol and a fraction of 20% of polyethylene oxide at a current density of 2 A/dm$^2$, 25° C. and a cathode movement of 1 m/min.

Example 4

In a Watts electrolyte having the following composition:
440 g/l nickel sulfate
30 g/l boric acid
40 g/l nickel chloride
5 g/l sodium saccharinate
a uniform matt effect is obtained after 10 minutes at a temperature of 52° C., a pH value of 4.2, a current density of 5 A/dm$^2$ and a cathode movement of 2 m/min, through the addition of 10 mg/l of the following CF-substituted polyethyleneglycol having an average molecular weight of 700 g/mol and denoted as a wetting agent, with the main component being characterized by X=5 and Y=10, $$F—(CF_2—CF_2)_x—(CH_2—CH_2—O)_y—H.$$

Example 5

If in example 4 the $CF_2$-substituted polyethyleneglycol is replaced by polyethyleneglycol substituted ammonium compounds, a uniform mattness effect is obtained having a different structure than in example 4. For instance, a nickel-plated brass sheet with a pearlescent effect can be obtained by the addition of 8 mg/l didecylmethylpoly-(oxethyl) ammonium propionate in a Watts electrolyte analogously with example 4.

Example 6

The emulsion of polyethyleneglycol-substituted ammonium salt produced in example 5 was added 1 ml/l PTFE suspension (Zonyl TE3667-N, Dupont), whereby different structures and properties of the layers were obtained. The surfaces thus produced exhibit a strongly hydrophobic dirt-repellent effect.

The invention claimed is:

1. An electrolytic composition for the deposition of a matt metal layer onto a substrate comprising:

a source of Ni ions;

an unsubstituted polyalkylene oxide as an emulsion and/or dispersion former; and a fluorinated wetting agent having the general formula $$R^f CH_2CH_2O(CH_2CH_2O)_xH$$

with $R^f$—$F(CF_2CF_2)_n$, wherein X=6 to 15 and n=2 to 10; and polytetrafluoroethylene particles with an average particle diameter of about 10 to about 1000 nm at a concentration of about 0.5 to 5 mg/L;

wherein the electrolytic composition forms a microemulsion and/or dispersion.

2. The electrolyte composition of claim 1 wherein said emulsion and/or dispersion former is selected from the group consisting of a polyethylene oxide, polypropylene oxide, polypropylene-polyethylene oxide block copolymer, and a mixture thereof.

3. The electrolyte composition of claim 2 wherein the emulsion and/or dispersion former has an average molecular weight >200 g/mol.

4. The electrolyte composition of claim 2 wherein the emulsion and/or dispersion former has a high percentage of hydrophobic structures and a molecular weight between about 200 and about 2000 g/mol.

5. The electrolyte composition of claim 2 wherein the emulsion and/or dispersion former has a high percentage of hydrophilic structures and a molecular weight >4000 g/mol.

6. The electrolyte composition of claim 1 wherein the average molecular weight of the fluorinated wetting agent is between about 550 and about 1000 g/mol.

7. The electrolyte composition of claim 1 wherein the average molecular weight of the fluorinated wetting agent is between about 700 and about 1000 g/mol.

8. The electrolytic composition of claim 1 wherein the polytetrafluoroethylene particles have an average particle diameter of about 100 to about 300 nm.

9. The electrolytic composition of claim 1 further comprising a wetting agent comprising a polyethylene oxide-substituted quaternary ammonium compound having the following general formula

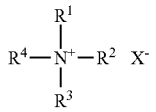

wherein one radical $R^1$, $R^2$, $R^3$ or $R^4$ is a polyethylene oxide substituent and the remaining radicals independently are same or different straight-chained or branched saturated or unsaturated $C_1$ to $C_{18}$ alkyl chains and $X^-$ is a halide, a sulfate anion or anion of a $C_1$ to $C_6$ carboxylic acid.

* * * * *